United States Patent [19]

Beard

[11] 4,405,065

[45] Sep. 20, 1983

[54] TILT VALVE STRUCTURE WITH BRIDGED STOP FOR VISCOUS FLOW LIQUIDS

[76] Inventor: Walter C. Beard, South St., Middlebury, Conn. 06762

[21] Appl. No.: 405,685

[22] Filed: Aug. 5, 1982

[51] Int. Cl.[3] ..... B67D 5/32

[52] U.S. Cl. ..... 222/153; 222/402.11

[58] Field of Search ..... 222/402.11, 402.21, 222/402.22, 402.1, 402.23, 402.24, 394, 153; 137/529, 540, 543.21

[56] References Cited

U.S. PATENT DOCUMENTS 3,441,177 4/1969 Treharne, Jr. .
3,547,405 12/1970 Ewald .
3,785,536 1/1974 Graham ..... 222/402.21

*Primary Examiner*—Stanley H. Tollberg
*Attorney, Agent, or Firm*—Hill, Van Santen, Steadman & Simpson

[57] ABSTRACT

A tilt valve structure for pressurized containers having a base seal which is operated by tiltable deflection of the nozzle to dispense the contents of the aerosol container. The valve structure incorporates a deformable bridge stop structure which retains the structure in a closed but assembled configuration after valve manufacture until usage, including assembly of valve onto a pressurizable container. The bridge stop structure can assume two positions: an initial position and a second valve operating position. The bridge stop structure can be formed of inelastic or elastic material, such as metal.

10 Claims, 5 Drawing Figures

TILT VALVE STRUCTURE WITH BRIDGED STOP FOR VISCOUS FLOW LIQUIDS

BACKGROUND OF THE INVENTION

1. Field of the Invention

This invention lies in the field of valves for containers adapted to dispense viscous fluids.

2. Description of the Prior Art

Valve assemblies of the type typically employed for aerosol type dispensing devices have heretofore been known wherein the valve is opened by manually deflecting an outer end region of a nozzle stem member from a vertical position into a tilted position relative to the center axis of the valve body. The deflection upsets or breaks a main seal existing between the nozzle dispensing orifice and an internal core member.

When such a tiltable valve assembly is modified and improved so as to permit same to be used for the dispensing of a highly viscous fluid problems arise in manufacturing because of the desire to produce complex valve assemblies which can be made, shipped, stored, and mounted on a pressurizable container without structural alteration. Because of the need to maintain suitable flow pathways in a tiltable valve assembly intended for use with dispensing highly viscous fluids, any clamping or holding means located on the back (interior) side of such an assembly for retaining individual valve components assembled together needs to be carefully structured so as not to interfere appreciably with fluid flow into and through the valve structure.

The type of representative valve body taught, for example, in Ewald U.S. Pat. No. 3,547,405 provides only a single, small entry channel into the valve interior in the region of the valve seat, and this channel's pathway is impeded by the presence of a biasing spring which is used to yieldingly urge the valve seat into a normally closed position. In the case of highly viscous fluids, such an arrangement offers sufficient frictional resistance to fluid flow as to make the entire assembly unusable for dispensing such fluids.

So far as is known, tiltable valve assemblies suitable for dispensing highly viscous fluids are not known which additionally have a tamper proof feature by which the valve remains sealed until use is accomplished.

The art needs new and improved complete valve assemblies adapted for viscous fluid dispensing wherein minimal interference to fluid flow into the region of the valve seat is provided and which have, if desired, a tamper-proof feature.

BRIEF SUMMARY OF THE INVENTION

This invention is directed to new and improved tiltable valve assemblies adapted for dispensing highly viscous fluids which can be manufactured into an assembled configuration and then subsequently stored and assembled onto a desired pressurizable container without further assembly modification and wherein minimal interference to fluid flow is provided from the container interior into the valve interior region about the main valve seat.

More particularly, the present invention provides a valve assembly of the type indicated wherein a deformable bridge stop means is incorporated on the back or interior side of the assembly. This bridge stop means retains the valve structure in a normally closed but assembled configuration after valve manufacture through storage, container assembly and filling until usage is desired. The bridge stop means characteristically can assume at least two positions: An initial position wherein the value is closed and a second position wherein the valve is operable.

When the bridge stop means is formed of substantially inelastic but distortable material, a tamper-proof feature is provided.

When the bridge stop means is formed of substantially elastic and flexible material, a self-biasing feature for configuring the valve structure in a normally closed arrangement is provided.

Other and further features, aims, objects, purposes, advantages, embodiments, and the like will be apparent to those skilled in the art from the accompanying specification taken with the drawings.

DETAILED DESCRIPTION

Figure 1:
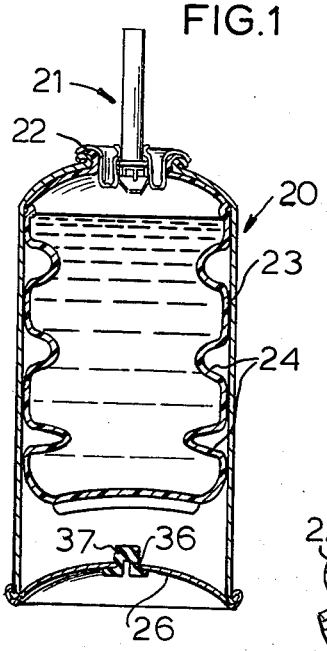
FIG. 1 is a vertical sectional view through one embodiment of a container fitted with one embodiment of valve structure of the present invention.

Referring to the drawings, a dispensing container or can 20 of a type heretofore known in the art is fitted on its top end with a tilt valve structure 21 of the present invention. Container 20 is provided with an axially located aperture 22 having a rolled perimeter, container 20 being formed in this instance of sheet metal.

Container 20 is provided with an interiorly located vessel 23 having pleated sidewall portions 24, the vessel 23 being formed of a resilient thermoplastic material or the like, such as high density polyethylene or the like. Such vessel 23 is conveniently inserted into the container 20 before a domed bottom cap 26 formed of metal or the like is press formed onto the bottom end of the container 20. The vessel 23 is provided with an axially located aperture 27 which has a lip 28 that extends partially over the rolled perimeter of aperture 22. The valve structure 21 includes a metallic mounting cup 29 which terminates in a roll 31 that makes nesting engagement with the rolled perimeter of aperture 22. Interior surfaces of the roll 31 are provided with a coating 26 formed of a sealing material of resilient elastomeric plastic composition, such as butadiene rubber or the like, so that, when the mounting cup 29 is fitted over the roll 31 and formed by collet fingers, there is produced a retraining crimp 33 and the preformed valve structure 21 is thus sealingly associated with the container 20.

With the valve structure 21 thus mounted to the container 20, the interior of the vessel 23 defines a first separate chamber in combination with adjoining portions of the valve structure 21 while a second separate chamber is defined between container 20, bottom cap 26 and vessel 23. Access to the interior of the second chamber is obtained through the bottom cup 26 which is provided with a centrally disposed aperture 36 that is sealingly closable by a plug 37 formed of a resilient elastomeric plastic material, such as a silicone rubber or the like. The first chamber is filled in a conventional manner with a viscous fluid material which is here preferably a viscous liquid which is to be dispensed through the valve structure 21. Thereafter, the second chamber is charged with a pressurizing substance after which the plug 37 is inserted into the aperture 36. As those skilled in the art appreciate, as a material that has been charged into the first chamber is dispensed through the valve structure 21, a relatively constant pressure is maintainable, if desired, in the second chamber by using as the pressurizing material a substance which is a low boiling liquid at ambient temperatures and which has a constant vapor pressure at such temperatures. As material is dispensed from the first chamber, the pleated sidewall portions 24 permit the volume of the first chamber to diminish correspondingly while the volume of the second chamber correspondingly enlarges. By regulating the quantity of pressurizing substance initially charged into the second chamber, the gas pressure maintained in the interior of the second chamber can remain relatively constant as the volume of the first chamber diminishes during dispensing of material from the first chamber.

While the valve structure 21 is particularly well suited for the dispensing of a highly viscous liquid which is substantially free from an entrained discontinuous phase which can produce bubbles in the dispensed viscous liquid, as from a chamber of a vessel 23 as described, as those skilled in the art will readily appreciate, the valve structure 21 is also suitable for the dispensing of a viscous fluid which has admixed therewith a gaseous propellant, for example, a propellant of the well-known low molecular weight fluorocarbon family. Valve 21 can also be used, if desired, for dispensing aerosols and gaseous fills generally. In the type of aerosol container illustrated in FIG. 1, an advantage is that the fill being dispensed is maintained in a separate environment from the environment occupied by the pressurizing substance. In this way, the fluid being dispensed is free from entrained pressurizing gas bubbles or the like which can sometimes be an important consideration when the material being dispensed is desired to be in a liquid or semisolid condition as opposed to being in a foaming or gaseous condition as is common to many aerosols. Examples of fills which one can dispense from a container with valve assembly as shown in FIG. 1 include, for example, sealants; lubricants, such as greases; foodstuffs, such as cheeses, food toppings, syrups, and the like; toothpastes; creams, such as shaving creams, dermal (e.g. hand or face) creams, and the like.

Figure 2:
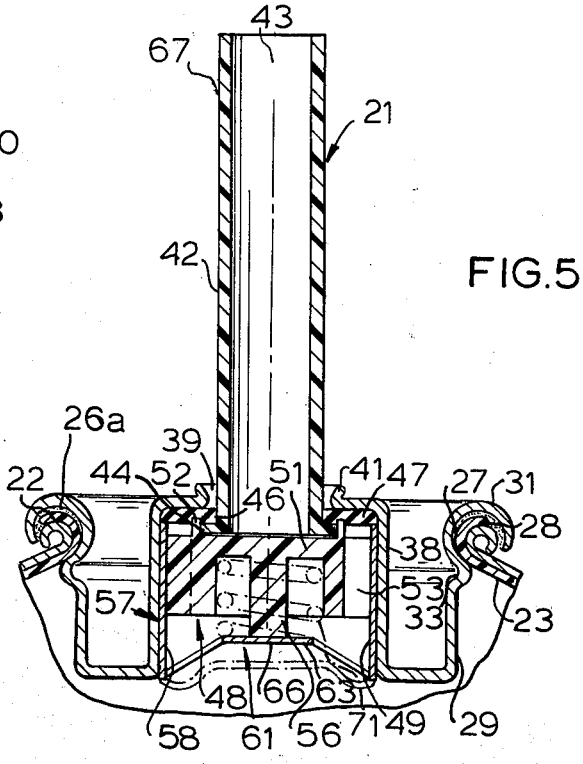
FIG. 2 is an enlarged fragmentary vertical sectional view along the axis of the valve structure shown in FIG. 1.
Figure 5:
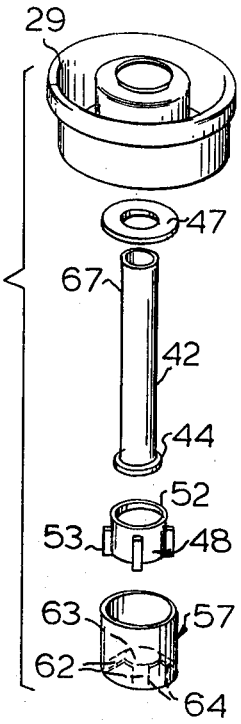
FIG. 5 is an exploded view of the valve components employed in the embodiment illustrated in FIGS. 1–4.

Referring to FIGS. 2 and 5, as those skilled in the art will appreciate, the internal diameter of the aperture 22 is typically standardized in the aerosol valve trade while the mounting cup 29 is so formed as to have an inner wall member 38 defined therein which can have a diameter particularly chosen for an individual type of valve structure desired. Axially, through the center portion of the mounting cup 29, an aperture 39 is defined which is optionally provided, as in the assembly 21, with an upstanding lip 41 which serves as a stiffening and reinforcing means. Through the aperture 39 is extended a nozzle stem member 42 which, at its upper end portion, is provided with a dispensing orifice 43. At the opposite end of the nozzle stem member 42, a radially outwardly extending flange 44 is provided which is here integrally formed with the nozzle stem member 42. The nozzle stem member 42 extends through the central aperture 46 of a resilient elastomeric gasket 47 which gasket 47 also makes abutting contact with both adjacent outer wall portions of the nozzle stem member 42 and flange 44. The outer perimeter of gasket 47 is seated in the center portion of the mounting cup 29. The nozzle stem member 42 is in a normally upright configuration as is illustrated in FIG. 2.

A moveable cup member 48 is disposed in the region of a central aperture 49 defined in the mounting cup 29. The moveable cup member 48 includes a valve plate 51 which transversely (relative to nozzle stem member 42) extends across flange 44 and is provided adjacent to its periphery with an integrally associated, upstanding rib portion 52 annularly extending thereabout. The rib portion 52 when the valve structure 21 is in its closed configuration as shown in FIG. 2 makes a seating engagement with adjacent portions of the gasket 47. Also, integrally associated with the valve plate 51 are a plurality of radially outwardly extending guide ribs 53 which are configured so as to be in a spaced, adjacent or even optionally contacting slidable relationship with respect to adjacent wall portions within the central aperture 49.

Between circumferentially adjacent pairs of guide ribs 53 substantial clearance passages 54 are provided that extend between the adjacent side wall portions of aperture 49 and valve plate portion 51 radially. The relatively extremely large openings or clearance passages 54 permit the passage through the valve assembly 21 of large volumes of material to be dispensed which is particularly desirable for the passage and dispensing of highly viscous fluid materials through valve structure 21.

The moveable cup member 48 is further provided with a centrally disposed foot 56 which is integrally associated therewith and which extends downwardly from said cup member 48 relative to stem member 42. Any convenient configuration and location can be utilized for the foot 56 as those skilled in the art will appreciate.

The valve structure 21 is additionally provided with a distortable bridge stop means, here represented by a cup shaped embodiment 57, which is preferably formed of metal, especially sheet metal. Sidewall portions 58 of bridge stop means 57 are frictionally engaged with adjacent sidewall portions 59 of the inner wall member 38 of mounting cup 29. Thus, the inner, crosssectionally generally circular wall surfaces of central aperture 49 are defined by the wall portions 58. In place of a frictional engagement between the sidewall portions 58 and the wall members 38, one can employ any convenient conventional securing means including adhesives, or the like, if desired.

The bottom or central portion of the bridge stop 57 is configured in the form of a spider wherein legs 62 join at their outer end portions with the sidewall portions 58 and at their inner end portion with the central section 63 of the bridge stop 57. The open areas 64 between circumferentially adjacent pairs of legs 62 provide apertures through which the fill contents being dispensed from a pressurized container 20 can pass when the valve structure 21 is in an open configuration. The structuring of the bridge stop 57 is preferably such as to maximize the total cross sectional area of the open areas 64 while still leaving sufficient rigidity in the legs 62 to make the legs 62 distortable by a pre-chosen amount of force applied against the central section 63 and stem member 43. In one presently preferred embodiment, the size of the open areas on apertures 64 is such that cumulatively such comprise at least 50 percent of the total surface area occupied by the legs 62, the central section 63 and the aperture 64.

A distortable bridge stop 57 is characteristically capable of assuming two configurations. One configuration is an initially assembled arrangement as shown, for example, in FIG. 2 wherein the bridge stop means 57 is adapted to maintain the moveable valve cup means 48 in an initially sealed condition against the resilient gasket member 47. The second configuration is a dispensing arrangement as shown, for example, in FIG. 3 wherein a spider portion of the bridge stop member 57, here including legs 62 and the central section 63, are centrally displaced away from the initially assembled position illustrated in FIG. 2.

In the initially assembled arrangement shown in FIG. 2, the central foot 56 at its distal end 66 contacts the central section 63 of bridge stop 57. In addition, the interior end or flange 44 of the nozzle stem member 42 is formed so as to be engageable with the moveable valve cup member 48. In the normally closed configuration for the tilt valve structure 21 shown in FIG. 2, which is a preferred embodiment, the flange 44 does not a make contacting engagement with the adjacent surface of the moveable cup member 48 in order to assure the achievement of an adequate seal between the rib portion 52 and the gasket 47.

Figure 3:
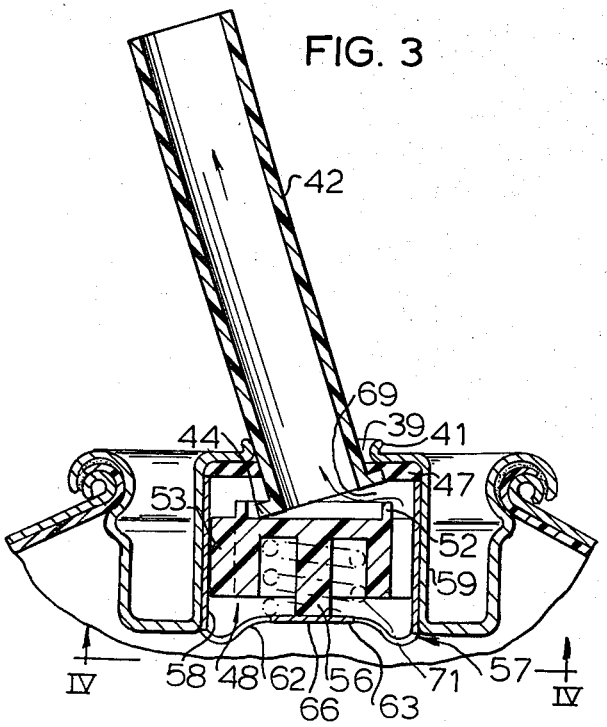
FIG. 3 is a view similar to FIG. 2, but illustrating such valve structure in an open (stem tilted) configuration.
Figure 4:
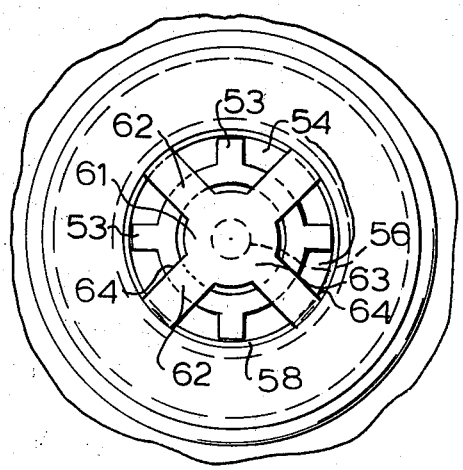
FIG. 4 is a transverse sectional view taken along the line IV—IV of FIG. 3.

When, an external operating deflecting force is applied against the outer or tip end 67 of the nozzle stem member 42, the flange 44 causes the central foot 56, as a distorting ram means, to move against the central section 63 of bridge stop means 57, thereby to move the central section 63 from the initially assembled arrangement shown in FIG. 2 to the second or normal operating configuration such as illustrated in FIG. 3. When the bridge stop means 57 is formed of a substantially inelastic but deformable material, preferably a somewhat greater initial deflecting force for achievement of a valve opening deflection of the tip end 63 is required than is subsequently required for such a deflection. In both the first and the second configurations of bridge stop means 57, deflection by an operating deflecting force of the tip end 67 effectuates an opening of the valve structure 21 whereby the seal between the rib portions 52 and the gasket 47 is broken, thereby permitting the pressurized contents within the container 20 to flow out of the container 20 successively past the open area 64, the clearance passages 54, and a gap 69 formed between rib portion 52 and gasket 47, as illustrated in FIG. 3.

When valve closure is desired, the tip end 67 is allowed to return to its normally upright configuration which effectuates a resealing between the rib portions 52 and the gasket 47. The resealing is effectuated either soley by the interior pressure exerted upon the underside of the moveable cup member 48 from the fill contents of the container 20, or by a combination of interior pressure and an (optional) spring means 71 shown in phantom in FIG. 2 and in FIG. 3. If employed, the spring 71 aids in effectuating a rapid and complete valve closure at termination of a valve dispensing operation. Observe that once such an inelastic distortable bridge stop means 57 has been placed into a configuration approximating that shown in FIG. 3 and shown also in phantom in FIG. 2, such bridge stop means 57 is permanently deformed does not again return to its initial configuration in normal operation.

One advantage associated with a valve structure 21 of the present invention is that a substantially inelastic but deformable bridge stop means 57 affords a species of tamper proof operating means whereby one can evaluate whether or not a given filled and pressurized container 20 has been previously opened. Thus, if a greater force than is required for a mere normal operating tilting of nozzle stem 42 to dispense a fill, then distortion of the inelastic bridge stop means 57 has not yet occurred, and so an operator knows that the central section 63 has not been previously downwardly deflected. On the other hand, if only the lesser force that is associated with normal valve operation is required to deflect the tip end 67 is observed before dispensing occurs, then the operation knows that a valve structure 21 on a container 20 has been previously operated and such bridge stop means 57 has already been moved to its second configuration.

In place of an inelastic bridge stop means 57, one can, if desired, employ an elastic and deformable bridge stop means, similarly configured, and formed of spring steel or the like. Such an elastic bridge stop means 57 is likewise capable of assuming the two configurations above described except that, after a tilting force on tip end 67 is removed following a dispensing operation, the elastic bridge stop means 57 returns to its initial configuration from its second configuration. The use of an elastic bridge stop means can eliminate the usage of an auxiliary spring 71.

A bridge stop means 57 provides a useful means for manufacturing and then retaining a tilt valve assembly of this invention in an assembled condition following its manufacture and during storage before same is assembled with a pressurizable container.

Although the teachings of my invention have herein been discussed with reference to specific embodiments, it is to be understood that these are by way of illustration only and that others may wish to utilize my invention in different designs or applications.

I claim:

1. A fluid dispensing valve structure for dispensing the contents of a pressurized container comprising:

a mounting cup member securable to said pressurized container and having communications with the pressurized contents of said container, a resilient seal member carried in said mounting cup member, an elongated tubular nozzle means having a dispensing orifice in one end thereof and having a second end supported in said mounting cup member by said resilient seal member in a generally upright extending position, a moveable valve cup member reciprocably slidably carried within said mounting cup member and normally being biased against said resilient seal member to form a seal means for normally sealing the contents of said container, and distortable bridge stop means associated with said mounting cup member in adjacent relationship to said moveable valve cup member, said bridge member being capable of assuming two configurations, one configuration being an initially assembled arrangement wherein said bridge stop means maintains said moveable valve cup means in an initially sealed condition against said resilient seal member, the second configuration being a dispensing arrangement wherein a portion of said bridge stop means is displaced away from said initially assembled arrangement, means for distorting said bridge stop means from said initially assembled arrangement to said dispensing arrangement and also for opening said valve structure from said initially sealed condition, said means including foot means extending from said moveable valve cup member to an initial contact with said portion, said second end being engageable with said moveable valve cup member, whereby when an external operating deflecting force is applied when said one end, said second end causes said distorting means to move said bridge means from said one configuration to said second configuration.

2. The valve structure of claim 1, wherein said distortable bridge stop means is comprised of an inelastic material which is permanently deformable by an initial such deflecting force which is greater than such a deflecting force needed to open said seal means once such a deformation has occurred and which is sufficient to move said bridge stop means from said one configuration to said second configuration.

3. The valve structure of claim 1, wherein said distortable bridge stop means is comprised of an elastic material which is deformable to said second configuration by such a deflecting force as is needed to open said seal means and which is sufficiently flexible to return to said one configuration in said valve structure when such deflecting force is removed.

4. The valve structure of claim 1, wherein said moveable cup member and said foot means are integrally formed and said foot means is centrally disposed relative to said moveable cup member and extends downwardly therefrom relative to said tubular nozzle means.

5. The valve structure of claim 1, wherein said distortable bridge stop means includes a centrally located spider configuration wherein a middle area is adjoined to an outer area by means of a plurality of interconnecting integral deflectable legs and wherein the apertures thus defined between circumferentially adjacent pairs of said legs provide fluid passages through said bridge stop means, and said foot means initially so contacts said middle area.

6. The valve structure of claim 5, wherein said apertures comprise more than 50 percent of the total surface area occupied by said legs, said middle area and said apertures.

7. The valve structure of claim 1, wherein auxiliary biasing means urging said moveable cup member into sealing engagement with said resilient seal member is additionally provided.

8. The valve structure of claim 5, wherein said outer area has portions which frictionally engage and thus orient adjacent portions of said mounting cup member and which additionally provide guidance surfaces for such reciprocal sliding.

9. A device for dispensing a highly viscous liquid, said device comprising (A) a pressurizable container and (B) a fluid dispensing valve structure secured to said container and having fluid communication with the interior thereof (C) said valve structure comprising in combination:

a mounting cup member securable to said pressurized container and having communication with the pressurized contents of said container, a resilient seal member carried in said mounting cup member, an elongated tubular nozzle means having a dispensing orifice in one end thereof and having a second end supported in said mounting cup member by said resilient seal member in a generally upright extending position, a moveable valve cup member reciprocally slidably carried within said mounting cup member and normally being biased against said resilient seal member to from a seal means for normally sealing the contents of said container, and distortable bridge stop means associated with said mounting cup member in adjacent relationship to said moveable valve cup member, said bridge member being capable of assuming two configurations, one configuration being an initially assembled arrangement wherein said bridge stop means maintains said moveable valve cup means in an initially sealed condition against said resilient seal member, the second configuration being a dispensing arrangement wherein a portion of said bridge stop means is displaced away from said initially assembled arrangement, means for distorting said bridge stop means from said initially assembled arrangement to said dispensing arrangement and also for opening said valve structure from said initially sealed condition, said means including foot means extending from said moveable valve cup member to an initial contact with said portion, said second end being engageable with said moveable valve cup member, whereby when an external operating deflecting force is applied when said one end, said second end causes said distorting means to move said bridge means from said one configuration to said second configuration.

10. The device of claim 9, wherein said pressurizable container further includes means separated said interior thereof into two chambers said separating means including moveable pressure responsive diaphragm means, one of said chambers being chargeable with a highly viscous liquid, the other of said chambers being chargeable with a pressurizing material, said one chamber being in fluid communicaton with said valve structure.

* * * * *